US009780477B1

(12) United States Patent
Rahman et al.

(10) Patent No.: US 9,780,477 B1
(45) Date of Patent: Oct. 3, 2017

(54) BOX TERMINAL WITH INSERTION LIMITER

(71) Applicant: Lear Corporation, Southfield, MI (US)

(72) Inventors: Sheikh Habibur Rahman, Macomb, MI (US); Michael Glick, Farmington Hills, MI (US); David Menzies, Linden, MI (US)

(73) Assignee: LEAR CORPORATION, Southfield, MI (US)

( * ) Notice: Subject to any disclaimer, the term of this patent is extended or adjusted under 35 U.S.C. 154(b) by 0 days.

(21) Appl. No.: 15/169,949

(22) Filed: Jun. 1, 2016

(51) Int. Cl.
*H01R 13/40* (2006.01)
*H01R 13/428* (2006.01)

(52) U.S. Cl.
CPC ..... *H01R 13/428* (2013.01)

(58) Field of Classification Search
CPC ..... H01R 13/428
USPC ..... 439/744, 752.5, 595
See application file for complete search history.

(56) References Cited

U.S. PATENT DOCUMENTS 3,085,221 A 4/1963 Kelly
3,885,849 A 5/1975 Bailey et al.
4,736,999 A 4/1988 Marks et al.
5,108,318 A * 4/1992 Sakurai ..... H01R 13/4223 439/595
5,425,656 A * 6/1995 Wakata ..... H01R 13/4365 439/595
6,394,856 B1 5/2002 Wertz
6,572,408 B2 * 6/2003 Yamanashi ..... H01R 13/4223 439/595
6,729,904 B2 * 5/2004 Nankou ..... H01R 43/16 439/595
6,764,352 B2 * 7/2004 Tsuji ..... H01R 13/4364 439/595
6,796,836 B2 * 9/2004 Ichida ..... H01R 13/113 439/595
7,347,741 B1 * 3/2008 Yeomans ..... H01R 4/185 439/744
7,938,699 B2 * 5/2011 Okano ..... H01R 4/185 439/877
8,113,881 B2 * 2/2012 Sakamoto ..... H01R 13/4223 439/595
8,366,494 B2 * 2/2013 Nishide ..... H01R 13/113 439/752.5
8,388,388 B2 * 3/2013 Suzuki ..... H01R 13/113 439/752.5

(Continued)

FOREIGN PATENT DOCUMENTS

EP 0386742 A1 9/1990

*Primary Examiner* — Abdullah Riyami
*Assistant Examiner* — Nelson R Burgos-Guntin
(74) *Attorney, Agent, or Firm* — MacMillan, Sobanski & Todd, LLC

(57) ABSTRACT

An electric connector includes a housing that defines an interior space. An electric terminal is located within the interior space in an installed position. The electric terminal includes a terminal body and a plurality of terminal arms extend from the terminal body in an insertion direction on opposed sides of a terminal axis. The electric terminal also includes a wire connection portion that extends from the terminal body. A channel is defined on one of the housing and the electric terminal, and a projection is on the other of the housing and the electric terminal. The projection is located in the channel.

19 Claims, 6 Drawing Sheets

(56) References Cited

U.S. PATENT DOCUMENTS

| | | | | |
|---|---|---|---|---|
| 2001/0006862 | A1* | 7/2001 | Suzuki | H01R 13/432<br>439/752.5 |
| 2004/0192119 | A1* | 9/2004 | Sakurai | H01R 13/64<br>439/752.5 |
| 2005/0266739 | A1* | 12/2005 | Wu | H01R 13/432<br>439/752.5 |
| 2011/0143588 | A1* | 6/2011 | Chikusa | H01R 13/4223<br>439/595 |
| 2012/0220173 | A1* | 8/2012 | Mizutani | H01R 13/113<br>439/752.5 |
| 2013/0065436 | A1* | 3/2013 | Hirabayashi | H01R 13/113<br>439/595 |
| 2015/0263456 | A1* | 9/2015 | Hashimoto | H01R 13/113<br>439/752.5 |
| 2015/0349448 | A1* | 12/2015 | Kawakami | H01R 13/114<br>439/744 |
| 2016/0072212 | A1* | 3/2016 | Shindo | H01R 13/4362<br>439/744 |

* cited by examiner

BOX TERMINAL WITH INSERTION LIMITER

BACKGROUND OF THE INVENTION

The present invention relates in general to electric connectors and, more specifically, to an electric connector that includes a feature to prevent the insertion of an incorrect terminal into the connector housing.

Electric connectors are used in a variety of applications for transferring electric current. In many situations, it is desirable to use a basic connector body that can include one or more of a variety of connector configurations depending on the intended use. The basic connector body can be used in a variety of different applications, and differently-sized contact gap electric terminals may be installed in the connector body, depending on the amount of electric current, for example. Typically, these electric terminals are labeled so that during assembly, the proper terminal is inserted into the body. It would be advantageous to have an improved way to properly pair an electric terminal with the connector body.

SUMMARY OF THE INVENTION

The invention relates to an electric connector. The electric connector includes a housing that defines an interior space. An electric terminal is located within the interior space in an installed position. The electric terminal includes a terminal body and a plurality of terminal arms that extend from the terminal body in an insertion direction on opposed sides of a terminal axis. The electric terminal also includes a wire connection portion that extends from the terminal body. A channel is defined on one of the housing and the electric terminal, and a projection is provided on the other of the housing and the electric terminal. The projection is located in the channel.

In another embodiment, the electric connector includes a housing that defines an interior space. A channel is also defined by the housing. An electric terminal is located within the interior space of the housing in an installed position. The electric terminal includes a terminal body. A plurality of terminal arms extend from the terminal body in an insertion direction on opposed sides of a terminal axis. A wire connection portion extends from the terminal body, and a projection extends from the terminal body in the insertion direction and in an outward direction away from the terminal axis. Also, the projection is located in the channel.

The invention also relates to a method of assembling an electric connector. The method includes selecting one of a plurality of housings, wherein the selected housing has a first insertion limit feature. The method also includes selecting between an electric terminal that has a second insertion limit feature and an alternative electric terminal that has an alternative second insertion limit feature and selecting the electric terminal. The method also includes inserting the electric terminal into the selected housing so that the electric terminal is in an installed position relative to the selected housing. The alternative second insertion limit feature on the alternative electric connector prevents the alternative electric terminal from being placed in the installed position relative to the selected housing.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
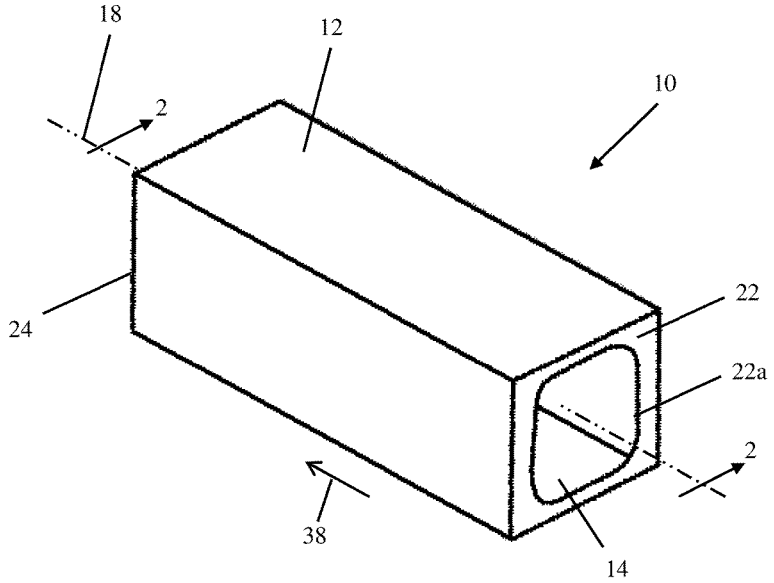
FIG. 1 is a perspective view of an assembled electric connector.
Figure 2:
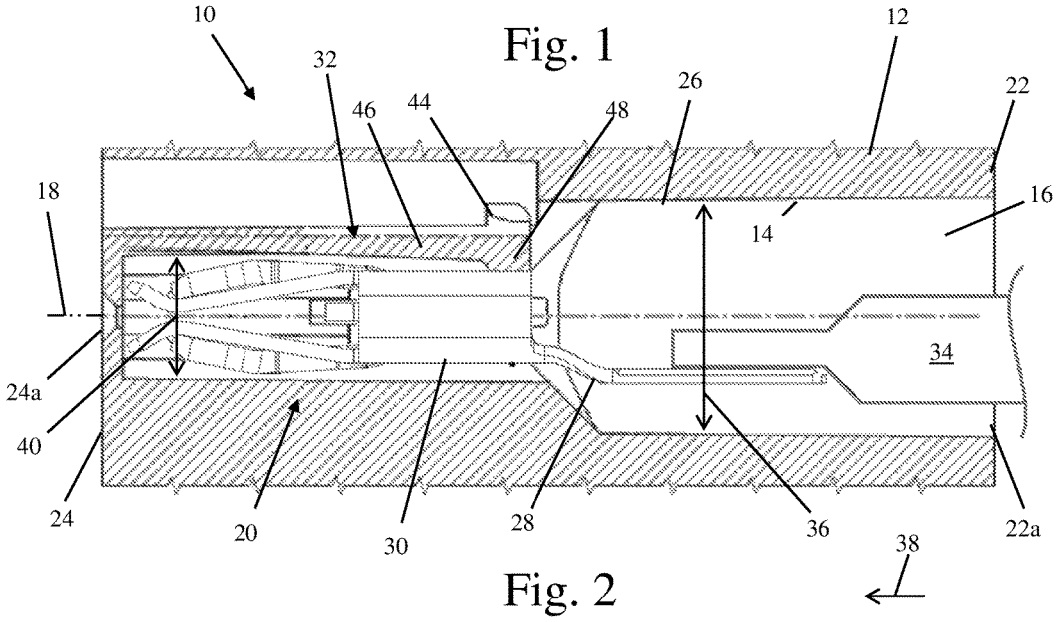
FIG. 2 is a cross-sectional view of the electric connector taken along line 2-2 of FIG. 1 with wire 34 connected.

Referring now to the drawings, there is illustrated in FIG. 1 and FIG. 2 an electric connector, indicated generally at 10. The electric connector 10 includes a housing 12 that defines a housing axis 18. The illustrated housing 12 is made of plastic, but may be made of any desired material. The illustrated housing 12 has a generally square cross-sectional outer shape, but may have any desired shaped. The illustrated housing 12 includes an interior wall 14 that defines an interior space 16. The illustrated interior space 16 also has a generally square cross-sectional shape with rounded corners, but the interior space 16 may have any desired shape. The interior space 16 extends along the housing axis 18.

The electric connector 10 includes an electric terminal, indicated generally at 20 in FIG. 2, that is supported on the housing 12. The illustrated electric terminal 20 is a female-type terminal and is made to mate with a complementary, blade-shaped, male-type terminal (not shown). However, the electric terminal 20 may be any desired type of terminal. The electric terminal 20 will be described in greater detail below. The housing 12 extends from an insertion end 22 to a mating end 24, and the interior space 16 extends from an insertion opening **22*a* at the insertion end 22 to a mating opening 24*a* at the mating end 24. In the illustrated embodiment, the insertion opening 22*a* and the mating opening 24*a* are on the opposed insertion and mating ends 22 and 24, respectively, of the housing 12 and the housing axis 18 extends through both the insertion opening 22*a* and the mating opening 24*a*. However, the insertion opening 22*a* and the mating opening 24*a* may have different relative positions if desired. For example, the electric terminal 20 may be a 90-degree-type connector and the insertion opening 22*a* and the mating opening 24*a* may be located at a 90 degree angle relative to each other. The interior space 16 includes a terminal wire area 26, wherein a wire connection portion 28 of the electric terminal 20 is located, and a terminal body area 30, wherein a body portion 32 of the electric terminal 20 is located. A wire 34 is connected to the wire connection portion 28 of the electric terminal 20 by sonic welding. The illustrated wire is made of copper, but may be made of any desired material. Additionally, the wire 34 may be connected to the wire connection portion 28 by any other desired connector or method. The terminal wire area 26 defines a first interior dimension 36 that is large enough to accommodate the wire connection portion 28 of the electric terminal 20 as well as the attached wire 34**.

To assemble the electric connector 10, the electric terminal 20 is moved along the housing axis 18 relative to the housing 12 in an insertion direction 38. The electric terminal 20 is oriented so that the body portion 32 of the electric terminal 20 passes through the insertion opening 22*a*, through the terminal wire area 26, and into the terminal body area 30, as shown in FIG. 2. The terminal body area 30 defines a second interior dimension 40 that is smaller than the first interior dimension 36. The second interior dimension 40 is large enough to accommodate the body portion 32 of the electric terminal 20. The assembly of the electric connector 10 will be described in greater detail below.

Figure 3:
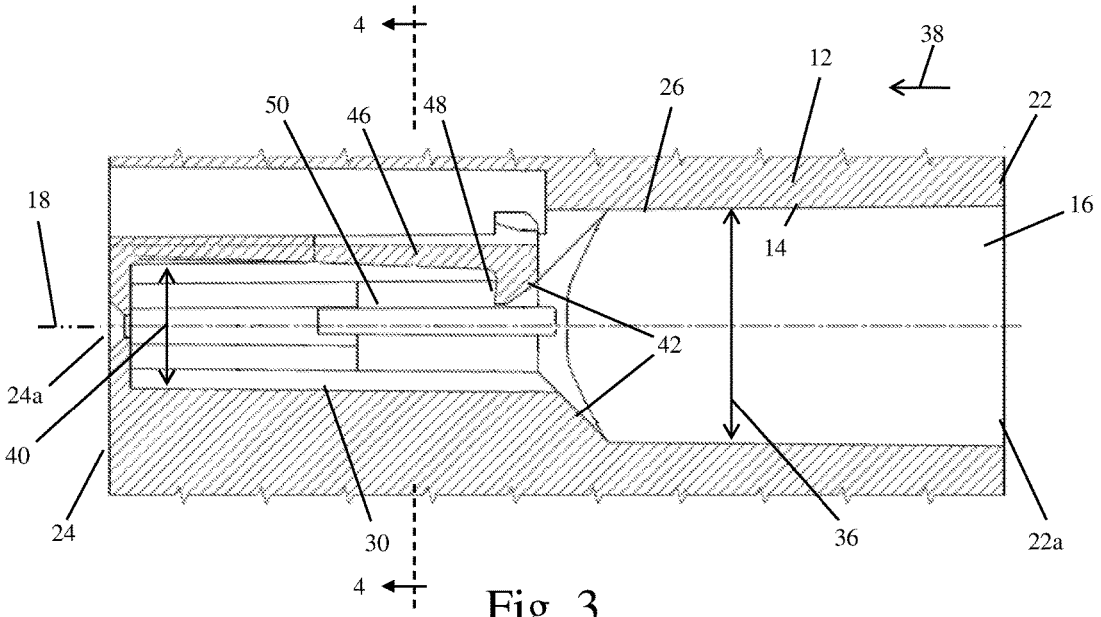
FIG. 3 is a cross-sectional view similar to FIG. 2, showing a connector housing of the electric connector with an electric terminal removed.

Referring now to FIG. 3, a cross-sectional view similar to FIG. 2 is shown, with the electric terminal 20 removed so that only the housing 12 is shown. The terminal wire area 26 of the housing 12 is located closer to the insertion end 22, and the insertion opening 22*a* opens into the terminal wire area 26. The terminal body area 30 is located closer to the mating end 24, and the mating opening 24*a* opens into the terminal body area 30. The housing 12 includes a transition 42 between the terminal wire area 26 and the terminal body area 30. The illustrated transition 42 includes a sloped surface that tapers the interior space 16 from the first interior dimension 36 in the terminal wire area 26 to the second interior dimension 40 in the terminal body area 30. The transition 42 also functions as a terminal guide that helps to position the electric terminal 20 properly in the terminal body area 30 when the electric connector 10 is assembled.

The housing 12 includes a first terminal lock feature 44 located in the terminal body area 30. The first terminal lock feature 44 serves to retain the electric terminal 20 in the installed position (shown in FIG. 2) relative to the housing 12. The illustrated first terminal lock feature 44 is a resilient arm 46 with a hook 48. However, the first terminal lock feature 44 may be any other desired structure and may be located in some other part of the housing 12, if desired. Additionally, the first terminal lock feature 44 may be located on the electric terminal 20 or may be a separate component if desired. A portion of the sloped surface of the transition 42 is located on the resilient arm 46. The housing 12 also includes a first insertion limit feature 50. As best seen in reference to FIG. 4, the illustrated first insertion limit feature is a channel defined in the interior wall 14 of the terminal body area 30. The first insertion limit feature 50 is provided to limit the insertion of the electric terminal 20 into the housing 12. The interaction between the electric terminal 20 and the resilient arm 46 as well as the first insertion limit feature 50 will be described below.

Figure 5:
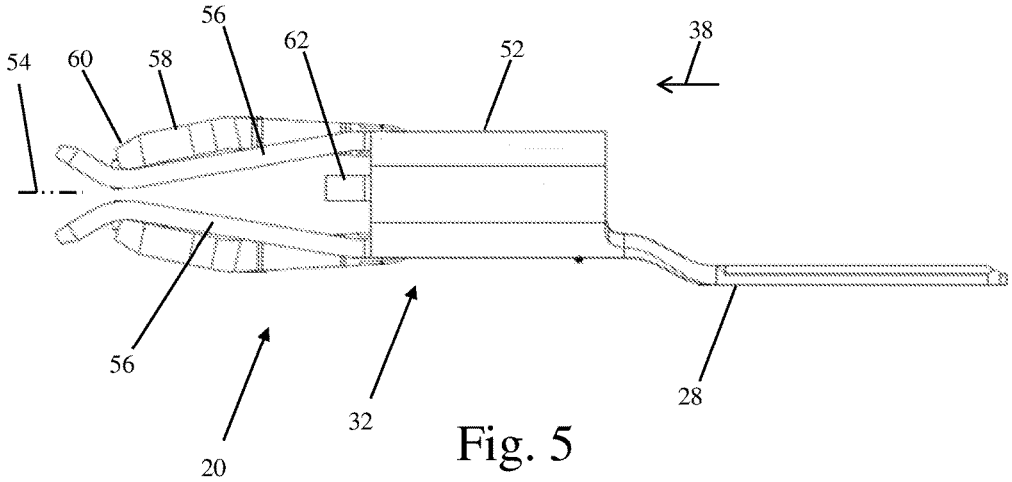
FIG. 5 is a side view of the electric terminal.
Figure 6:
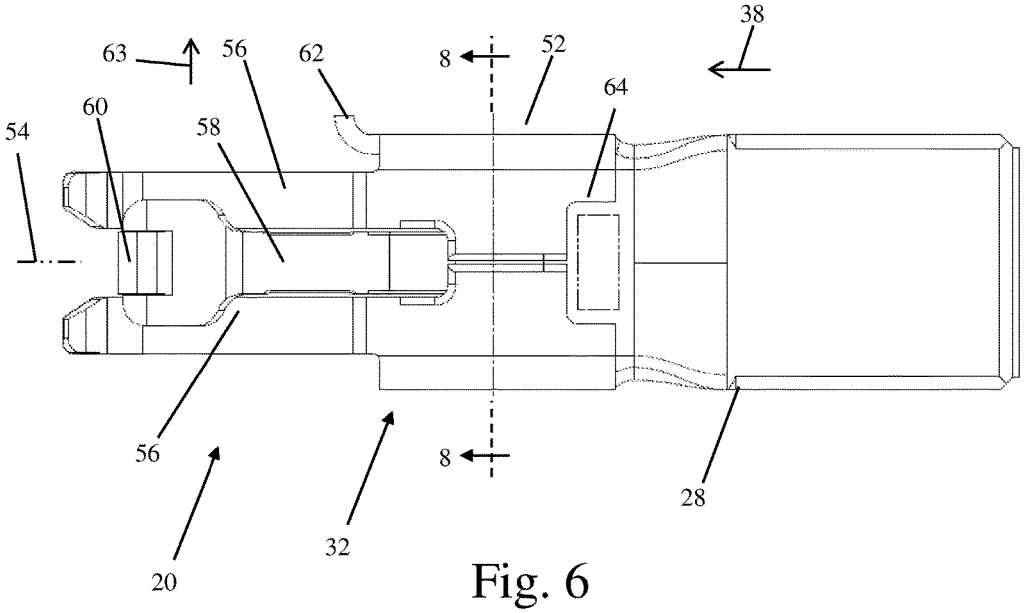
FIG. 6 is a top view of the electric terminal.
Figure 7:
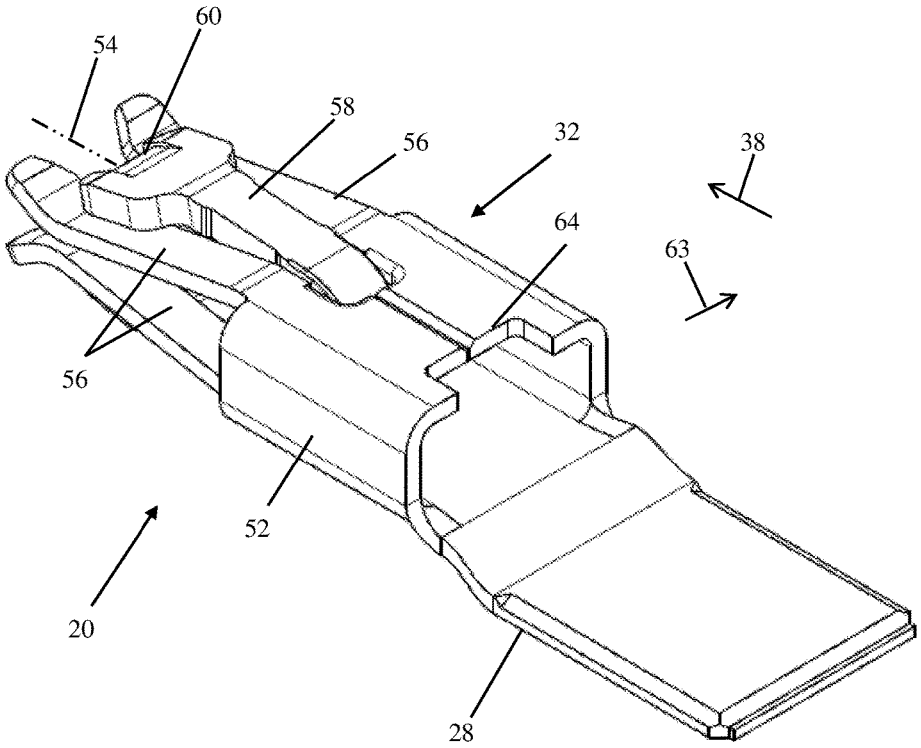
FIG. 7 is a perspective view of the electric terminal.

Referring now to FIGS. 5, 6 and 7 the electric terminal 20 is shown. As previously described, the illustrated electric terminal 20 is a female-type electric terminal. The body portion 32 of the electric terminal 20 includes a terminal body 52 that has a generally rectangular cross-sectional shape and defines a terminal axis 54. A plurality of terminal arms 56 extend from the terminal body 52 in the insertion direction 38. The illustrated electric terminal 20 includes four terminal arms 56 that are disposed in pairs on opposed sides of the terminal axis 54. The wire connection portion 28 extends from the terminal body 52 in a direction that is opposite the insertion direction 38. The illustrated electric terminal 20 includes an optional spring 58 that is connected to the body portion 32 and applies a force to bias the terminal arms 56 toward one another. The electric terminal 20 includes a terminal surface 60 that cooperates with the resilient arm 46 in the housing 12, as will be described below. The illustrated terminal surface 60 is located on the spring 58, but may be located on any desired part of the electric terminal 20.

The electric terminal 20 includes a second insertion limit feature 62. The second insertion limit feature 62 cooperates with the first insertion limit feature 50 on the housing 12, as will be described below. The illustrated second insertion limit feature 62 is a projection that extends from the terminal body 52 in the insertion direction 38 and also in an outward direction 63 away from the terminal axis 54. The second insertion limit feature 62 may be placed on any other desired location on the electric terminal 20. The electric terminal 20 also includes a second terminal lock feature 64 that cooperates with the first terminal lock feature 44 on the housing 12 to retain the electric terminal 20 in the installed position (shown in FIG. 2) relative to the housing 12. The illustrated second terminal lock feature 64, as best seen in FIG. 7, is a detent in the terminal body 52. However, the second terminal lock feature 64 may be located on any desired part of the electric terminal 20.

To assemble the electric connector 10, the electric terminal 20 is positioned relative to the housing 12 so that the housing axis 18 and the terminal axis 54 are substantially co-linear and so that the terminal arms 56 extend toward the housing 12. The electric terminal 20 is then moved in the insertion direction 38 relative to the housing 12 so that the terminal arms 56 enter the interior space 16 through the insertion opening 22*a*. The terminal surface 60 on the electric terminal 20 engages the portion of the sloped surface of the transition 42 that is located on the resilient arm 46. By continuing to move the electric terminal 20 in the insertion direction 38 relative to the housing 12, the resilient arm 46 is pushed away from the housing axis 18, and the hook 48 will slide along the spring 58 and the terminal body 52. Additionally, the second insertion limit feature 62 (the projection on the terminal body 52) will enter the first insertion limit feature 50 (the channel defined in the interior wall 14 of the terminal body area 30). When the electric terminal 20 has been moved to the installed position, the hook 48 on the resilient arm 46 is positioned over the detent in the terminal body 52 and the resilient arm 46 will deflect back toward the housing axis 18. The first terminal lock feature 44 then cooperates with the second terminal lock feature 64 to prevent the electric terminal 20 from being moved back out of the housing 12. The electric connector 10 is then in the assembled state shown in FIG. 2.

It should be appreciated that while the illustrated first insertion limit feature 50 is the channel defined in the interior wall 14 of the terminal body area 30 and the second insertion limit feature 62 is the projection on the terminal body 52, these features may be reversed if desired, so that the projection is on the housing 12 and the channel is on the electric terminal 20. Additionally, while the illustrated first terminal lock feature 44 is the resilient arm 46 located on the housing and the second terminal lock feature 64 is the detent in the terminal body 52, these features may be reversed if desired.

Figure 8:
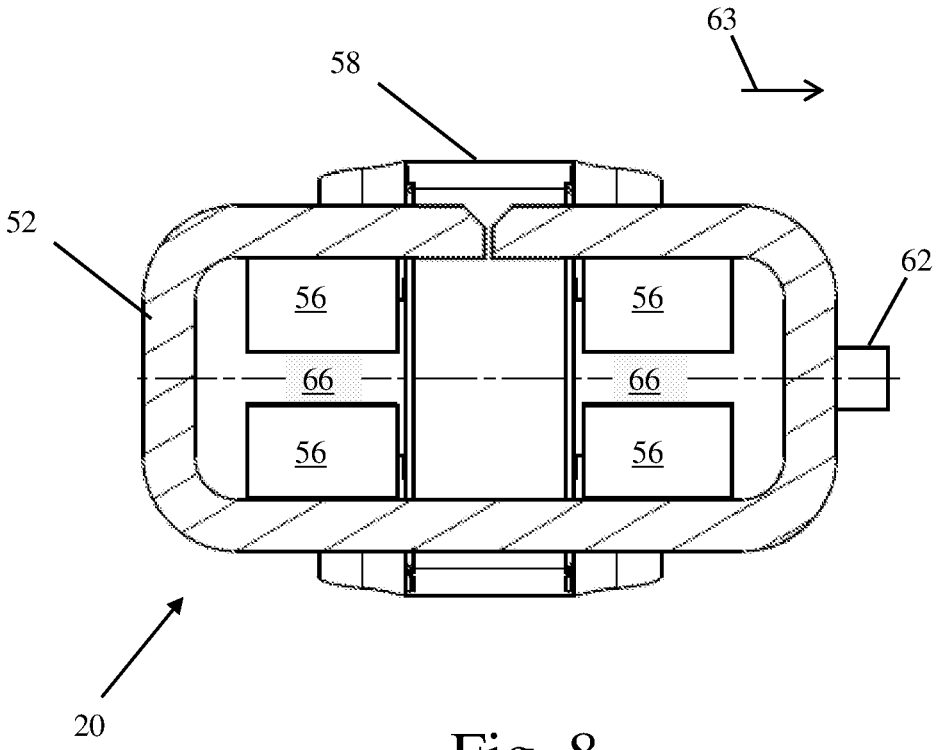
FIG. 8 is a cross-sectional view of the electric terminal taken along line 8-8 of FIG. 6.

Referring now to FIG. 8, a cross-sectional view of the electric terminal 20 is shown, taken along the line 8-8 of FIG. 6. As shown, there is a gap 66 located between the opposed terminal arms 56. It should be appreciated that when the electric connector 10 is mated with the complementary male-type terminal, the male blade will be located in the gap 66.

Figure 9:
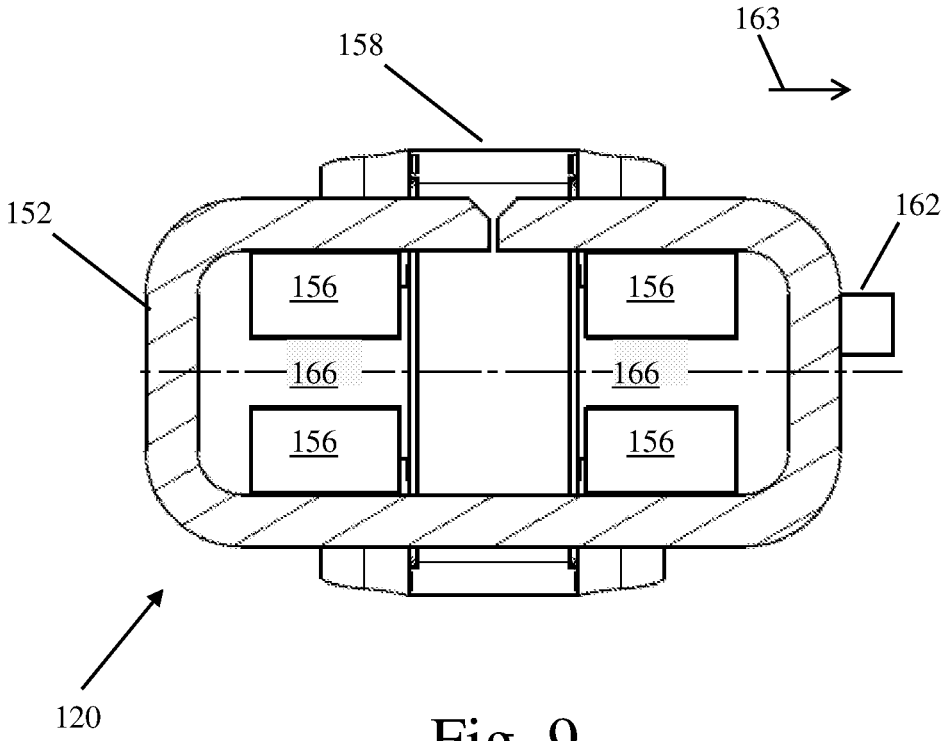
FIG. 9 is a cross-sectional view similar to FIG. 8, of an alternative electric terminal that includes an alternative insertion limiter in a different location.

Referring to FIG. 9, a cross-sectional view similar to that of FIG. 8 is shown of an alternative embodiment of an electric terminal 120. The alternative electric terminal 120 is substantially similar to the electric terminal 20 and will not be described in detail. The alternative electric terminal 120 has an alternative gap 166 between alternative terminal arms 156 that is larger than the gap 66 on the electric terminal 20. The alternative electric terminal 120 is designed to mate with a different complementary, blade-shaped, male-type terminal (not shown).

The alternative electric terminal 120 also has an alternative second insertion limit feature 162 that is located in a different position on an alternative terminal body 152 as compared to the second insertion limit feature 62 on the electric terminal 20. If the alternative electric terminal 120 is inserted into the housing 12, the alternative second insertion limit feature 162 will not enter the first insertion limit feature 50. Rather, the alternative second insertion limit feature 162 will engage the interior wall 14 of the terminal body area 30, which will prevent the alternative electric terminal 120 from being fully inserted into the housing 12. The alternative electric terminal 120 has substantially the same outer dimensions as the electric terminal 20, and could fit into the interior space 16 of the housing 12, except for the engagement of the alternative second insertion limit feature 162 with the housing 12.

Figure 4:
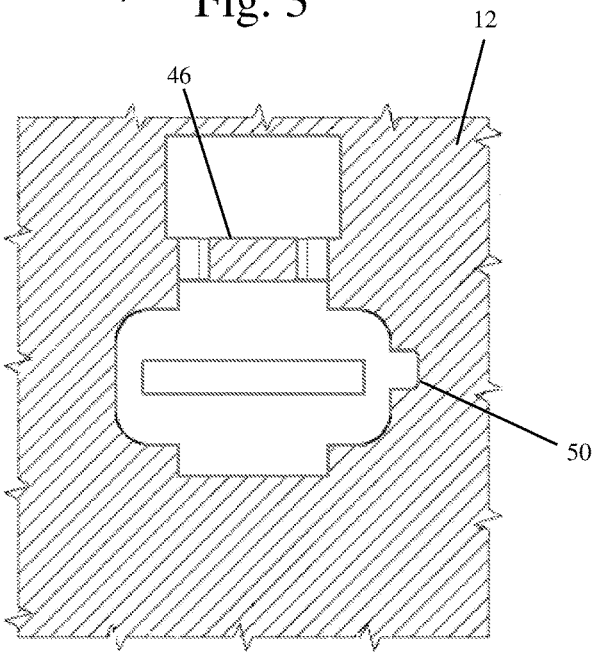
FIG. 4 is a cross-sectional view of the connector housing taken along line 4-4 of FIG. 3.
Figure 10:
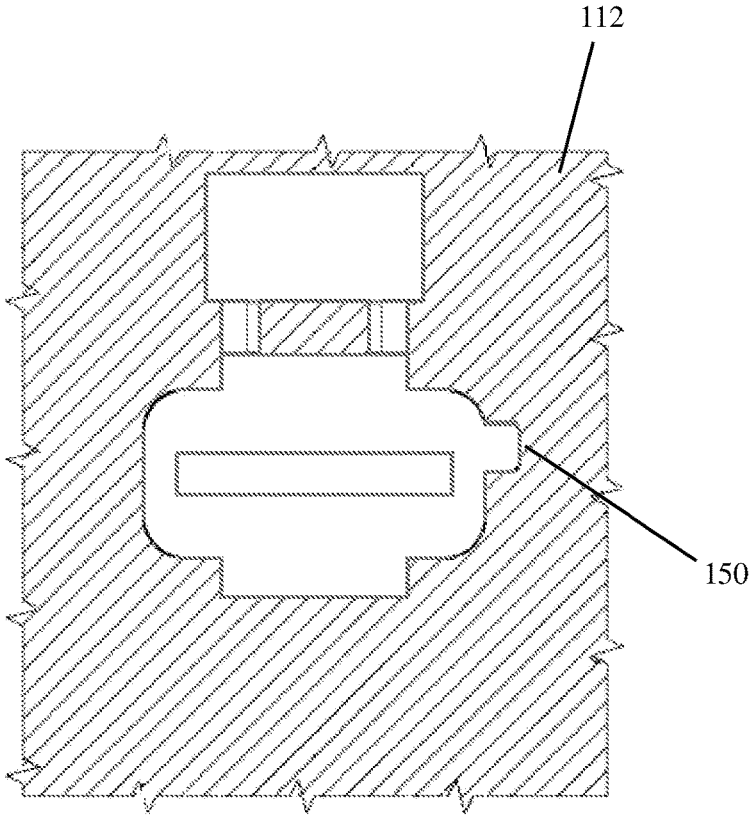
FIG. 10 is a cross-sectional view similar to FIG. 4, of an alternative housing that includes an alternative insertion limit feature.

Referring to FIG. 10, a cross-sectional view similar to that of FIG. 4 is shown, of an alternative housing 112. The alternative housing 112 is substantially similar to the housing 12 and will not be described in detail. The alternative housing 112 includes an alternative first insertion limit feature 150 that allows insertion of the alternative electric terminal 120 but will prevent insertion of the electric terminal 20. It should be appreciated that this allows the housing 12 and the alternative housing 112 to have substantially identical dimensions and substantially identical outward appearance, while preventing the alternative electric terminal 120 from being improperly assembled with the housing 12.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electric connector comprising:

a housing that defines an interior space including a terminal wire area having a first interior dimension and a terminal body area having a second interior dimension that is less than the first interior dimension;

an electric terminal including a body portion having a terminal body disposed in the terminal body area of the housing, a plurality of terminal arms that extend from the terminal body in the terminal body area of the housing, and a wire connection portion that extends from the terminal body in the terminal wire area of the housing;

a channel is defined on one of the terminal body area of the housing and the body portion of the electric terminal; and, a projection is defined on the other of the terminal body area of the housing and the body portion of the electric terminal, wherein the projection is located in the channel.

2. The electric connector of claim 1, further comprising:

a first terminal lock feature on the housing, a second terminal lock feature on the electric terminal that cooperates with the first terminal lock feature to retain the body portion in the terminal body area.

3. The electric connector of claim 2, wherein the first terminal lock feature is a resilient arm with a hook that is engaged with the terminal body of the electric terminal.

4. The electric connector of claim 3, wherein the hook is engaged with a detent defined by the terminal body.

5. The electric connector of claim 4, wherein the terminal arms extend in an insertion direction on opposed sides of a terminal axis, the channel is defined on the terminal body area of the housing and the projection extends from the body portion of the electric terminal in the insertion direction and in an outward direction away from the terminal axis.

6. A method of assembling an electric connector, the method comprising:

selecting a housing having a first insertion limit feature;

selecting, from one of an electric terminal having a second insertion limit feature and an alternative electric terminal having an alternative second insertion limit feature, the electric terminal; and inserting the electric terminal into the selected housing so that a body portion of the electric terminal is in a terminal body area of the selected housing, wherein the alternative second insertion limit feature on the alternative electric connector prevents an alternative body portion of the alternative electric terminal from being placed in the terminal body area.

7. The method of claim 6, further comprising the steps of:

selecting an alternative housing having an alternative first insertion limit feature; and inserting the alternative electric terminal into the alternative housing so that the alternative body portion is in an alternative terminal body area of the alternative housing.

8. The method of claim 6, wherein the step of inserting the electric terminal into the selected housing further includes engaging a first terminal lock feature on the selected housing with a second terminal lock feature on the electric terminal to retain the body portion in the terminal body area.

9. The method of claim 8, further comprising the steps of:

selecting an alternative housing having an alternative first insertion limit feature;

inserting the alternative electric terminal into the alternative housing so that a body portion of the alternative electric terminal is in an alternative terminal body area of the alternative housing; and engaging an alternative first terminal lock feature on the alternative housing with an alternative second terminal lock feature on the alternative electric terminal to retain the alternative body portion in the alternative terminal body area.

10. The method of claim 6, wherein the electric terminal includes a terminal body having outer dimensions and the alternative electric terminal includes an alternative terminal body having substantially similar outer dimensions to the terminal body.

11. The electric connector of claim 1, wherein the channel is defined on the terminal body area of the housing and the projection is defined on the body portion of the electric terminal.

12. The electric connector of claim 1, wherein the channel is defined on the body portion of the electric terminal and the projection is defined on the terminal body area of the housing.

13. The electric connector of claim 1, wherein the channel is defined only on the terminal body area of the housing or the body portion of the electric terminal.

14. The electric connector of claim 1, further comprising:

a transition in the housing between the terminal wire area and the terminal body area; and a mating opening in the terminal body area opposite the terminal wire area, wherein the channel is defined on the terminal body area of the housing, starts in the transition, and extends towards the mating opening.

15. The electric connector of claim 1, further comprising:

a transition in the housing between the terminal wire area and the terminal body area;

a first side between the transition and the terminal wire area; and a second side between the transition and the terminal body area, wherein the channel or projection defined on the terminal body crosses the second side and does not cross the first side.

16. The electric connector of claim 1, further comprising:

a terminal axis along which the electric connector extends and the terminal body area is centered; and a distance perpendicular from the terminal axis to a furthest extend of the channel, wherein the distance is less than half of the first interior dimension and greater than half of the second interior dimension and the distance, terminal axis, first interior dimension, second interior dimension are in a plane.

17. A method of assembling an electric connector, the method comprising:

selecting a housing that defines an interior space having a terminal wire area with a first interior dimension and a terminal body area with a second interior dimension that is less than the first interior dimension, wherein the terminal body area has a first insertion limit feature;

selecting an electric terminal having a body portion and a wire connection portion that extends from a terminal body of the body portion, wherein the body portion has a second insertion limit feature;

inserting the body portion into the terminal body area, wherein the first insertion limit feature cooperates with the second insertion limit feature to allow the body portion to enter the terminal body area; and inserting the wire connection portion into the terminal wire area of the housing.

18. The method of claim 17, wherein one of the first insertion limit feature and the second insertion limit feature enters the other of the first insertion limit feature and the second insertion limit feature when the body portion is inserted into the terminal body area.

19. The method of claim 17, further comprising the step of:

inserting the body portion through the terminal wire area without the first insertion limit feature entering the second insertion limit feature.

* * * * *